US007942757B2

(12) United States Patent
Blumenkrantz et al.

(10) Patent No.: US 7,942,757 B2
(45) **Date of Patent: *May 17, 2011**

(54) STRIKE FACE INSERT

(75) Inventors: Mark Blumenkrantz, Huntington Beach, CA (US); Michael J. Wallans, Huntington Beach, CA (US)

(73) Assignee: SRI Sports Limited, Kobe-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/844,079

(22) Filed: Jul. 27, 2010

(65) Prior Publication Data

US 2010/0292026 A1 Nov. 18, 2010

Related U.S. Application Data

(63) Continuation of application No. 12/071,472, filed on Feb. 21, 2008, now Pat. No. 7,794,333.

(51) Int. Cl.
*A63B 53/04* (2006.01)
*A63B 69/36* (2006.01)

(52) U.S. Cl. ..... 473/331; 473/342; 473/349; 473/350; 473/238; 473/242

(58) Field of Classification Search ..... 473/324–350, 473/287–292, 238, 242
See application file for complete search history.

(56) References Cited

U.S. PATENT DOCUMENTS 1,968,627 A 7/1934 Young
1,975,341 A 10/1934 Young
3,847,399 A 11/1974 Raymont
3,970,236 A 7/1976 Rogers
3,975,023 A 8/1976 Inamori
4,027,885 A 6/1977 Rogers
4,569,524 A 2/1986 Quijano
4,679,792 A 7/1987 Straza et al.
4,792,140 A * 12/1988 Yamaguchi et al. ..... 473/331
5,016,883 A 5/1991 Kobayashi
5,344,140 A 9/1994 Anderson
5,358,249 A 10/1994 Mendralla
5,403,007 A 4/1995 Chen
5,407,202 A 4/1995 Igarashi
5,423,535 A 6/1995 Shaw et al.
5,425,535 A 6/1995 Gee
5,433,440 A 7/1995 Lin
5,439,223 A 8/1995 Kobayashi
5,465,968 A 11/1995 Aizawa et al.
5,489,098 A 2/1996 Gojny et al.
5,492,327 A 2/1996 Biafore
5,518,242 A 5/1996 Mahaffey
5,531,439 A 7/1996 Azzarella
5,547,194 A 8/1996 Aizawa et al.
5,603,667 A 2/1997 Ezaki et al.

(Continued)

FOREIGN PATENT DOCUMENTS

JP A-11-216205 8/1999

(Continued)

*Primary Examiner* — Sebastiano Passaniti
(74) *Attorney, Agent, or Firm* — Oliff & Berridge, PLC

(57) ABSTRACT

A golf club head, according to one or more aspects of the present invention, comprises a metallic striking wall having a striking surface and at least one through score-line opening. At least one complementary component may be disposed rearward of the striking surface such that at least a part of the at least one complementary component extends into only a part of the at least one through score-line opening.

20 Claims, 12 Drawing Sheets

U.S. PATENT DOCUMENTS

| | | | |
|---|---|---|---|
| 5,620,382 | A | 4/1997 | Cho et al. |
| 5,643,103 | A | 7/1997 | Aizawa |
| 5,658,208 | A | 8/1997 | Shimasaki |
| 5,697,855 | A | 12/1997 | Aizawa |
| 5,713,800 | A | 2/1998 | Su |
| 5,718,644 | A | 2/1998 | Donofrio |
| 5,735,755 | A | 4/1998 | Kobayashi |
| 5,749,794 | A | 5/1998 | Kobayashi et al. |
| 5,766,093 | A | 6/1998 | Rohrer |
| 5,766,094 | A | 6/1998 | Mahaffey et al. |
| 5,772,527 | A | 6/1998 | Liu |
| 5,779,560 | A | 7/1998 | Buck et al. |
| 5,797,176 | A | 8/1998 | Rose et al. |
| 5,803,825 | A | 9/1998 | Hamilton |
| 5,807,189 | A | 9/1998 | Martin et al. |
| 5,807,190 | A | 9/1998 | Krumme et al. |
| 5,816,936 | A | 10/1998 | Aizawa et al. |
| 5,827,131 | A | 10/1998 | Mahaffey et al. |
| 5,842,934 | A | 12/1998 | Ezaki et al. |
| 5,871,408 | A | 2/1999 | Chen |
| 5,879,243 | A | 3/1999 | Hackman |
| 5,896,642 | A | 4/1999 | Peker et al. |
| 5,899,818 | A | 5/1999 | Zider et al. |
| 5,899,820 | A | 5/1999 | Minematsu et al. |
| 5,935,018 | A | 8/1999 | Takeda |
| 5,944,619 | A | 8/1999 | Cameron |
| 5,951,412 | A | 9/1999 | Rose et al. |
| 5,967,903 | A | 10/1999 | Cheng |
| 5,997,414 | A | 12/1999 | Dalton |
| 6,001,031 | A | 12/1999 | San Juan |
| 6,001,032 | A | 12/1999 | Onuki et al. |
| 6,007,434 | A | 12/1999 | Baker et al. |
| 6,030,294 | A | 2/2000 | Shira |
| 6,074,309 | A | 6/2000 | Mahaffey |
| 6,083,117 | A | 7/2000 | Hsu |
| 6,086,484 | A | 7/2000 | Uebelhor |
| 6,089,992 | A | 7/2000 | Onuki et al. |
| 6,089,993 | A | 7/2000 | Woodward et al. |
| 6,093,116 | A | 7/2000 | Hettinger et al. |
| 6,117,023 | A | 9/2000 | Onuki et al. |
| 6,129,953 | A | 10/2000 | Mertens |
| 6,155,934 | A | 12/2000 | Pinns |
| 6,162,130 | A | 12/2000 | Masumoto et al. |
| 6,171,203 | B1 | 1/2001 | Huang |
| 6,176,791 | B1 | 1/2001 | Wright |
| 6,179,727 | B1 | 1/2001 | Giordano |
| 6,183,381 | B1 | 2/2001 | Grant et al. |
| 6,200,228 | B1 | 3/2001 | Takeda |
| 6,200,229 | B1 | 3/2001 | Grace et al. |
| 6,217,460 | B1 | 4/2001 | Broadbridge et al. |
| 6,220,971 | B1 | 4/2001 | Takeda |
| 6,224,496 | B1 | 5/2001 | Rowland et al. |
| 6,224,497 | B1 | 5/2001 | Antonious |
| 6,227,986 | B1 | 5/2001 | Fisher |
| 6,231,458 | B1 | 5/2001 | Cameron et al. |
| 6,238,303 | B1 | 5/2001 | Fite |
| 6,258,183 | B1 | 7/2001 | Onuki et al. |
| 6,261,192 | B1 | 7/2001 | Otani |
| 6,270,423 | B1 | 8/2001 | Webb |
| 6,277,033 | B1 | 8/2001 | Krumme et al. |
| 6,302,807 | B1 | 10/2001 | Rohrer |
| 6,334,818 | B1 | 1/2002 | Cameron et al. |
| 6,428,424 | B2 | 8/2002 | Franco |
| 6,428,425 | B1 | 8/2002 | Naruo et al. |
| 6,435,981 | B2 | 8/2002 | Naruo et al. |
| 6,443,857 | B1 | 9/2002 | Chuang |
| 6,450,894 | B1 | 9/2002 | Sun et al. |
| 6,481,088 | B1 | 11/2002 | Inoue et al. |
| 6,488,594 | B1 | 12/2002 | Card et al. |
| 6,491,593 | B2 | 12/2002 | Takeda |
| 6,524,198 | B2 | 2/2003 | Takeda |
| 6,554,721 | B1 | 4/2003 | Woodward et al. |
| 6,592,467 | B1 | 7/2003 | Gray |
| 6,616,546 | B2 | 9/2003 | Cho |
| 6,638,179 | B2 | 10/2003 | Yoshida |
| 6,652,390 | B2 | 11/2003 | Bradford |
| 6,663,496 | B2 | 12/2003 | Cameron et al. |
| 6,688,989 | B2 | 2/2004 | Best |
| 6,692,378 | B2 | 2/2004 | Shmoldas et al. |
| 6,699,140 | B1 | 3/2004 | Sun |
| 6,723,002 | B1 | 4/2004 | Barlow |
| 6,743,114 | B2 | 6/2004 | Best |
| 6,746,343 | B2 | 6/2004 | Yoneyama |
| 6,746,344 | B1 | 6/2004 | Long |
| 6,852,041 | B1 | 2/2005 | Huang |
| 6,855,066 | B2 | 2/2005 | Best |
| 6,860,820 | B2 | 3/2005 | Specht |
| 6,902,496 | B2 | 6/2005 | Solheim et al. |
| 6,916,253 | B2 | 7/2005 | Takeda |
| 6,918,841 | B2 | 7/2005 | Chen |
| 6,932,716 | B2 | 8/2005 | Ehlers et al. |
| 6,991,559 | B2 | 1/2006 | Yabu |
| 6,997,820 | B2 | 2/2006 | Willett et al. |
| 7,014,571 | B2 | 3/2006 | Deshmukh |
| 7,018,305 | B2 | 3/2006 | Sugimoto |
| 7,022,031 | B2 | 4/2006 | Nishio |
| 7,025,693 | B2 | 4/2006 | Sugimoto |
| 7,025,694 | B2 | 4/2006 | Huang |
| 7,037,211 | B1 | 5/2006 | Kosovac |
| 7,066,834 | B2 | 6/2006 | Yamamoto |
| 7,083,525 | B2 | 8/2006 | Pond et al. |
| 7,083,526 | B2 | 8/2006 | Durnin |
| 7,086,963 | B1 | 8/2006 | Onuki et al. |
| 7,115,048 | B2 | 10/2006 | Kusumoto et al. |
| 7,134,971 | B2 | 11/2006 | Franklin et al. |
| 7,140,974 | B2 | 11/2006 | Chao et al. |
| 7,144,334 | B2 | 12/2006 | Ehlers et al. |
| 7,144,335 | B2 | 12/2006 | Breier et al. |
| 7,144,336 | B2 | 12/2006 | Reyes et al. |
| 7,144,337 | B2 | 12/2006 | Hirano |
| 7,147,574 | B2 | 12/2006 | Vesligaj |
| 7,160,204 | B2 | 1/2007 | Huang |
| 7,192,365 | B2 | 3/2007 | Souza et al. |
| 7,393,287 | B2 | 7/2008 | Huang |
| 7,594,862 | B2 | 9/2009 | Gilbert |
| 7,794,333 | B2 * | 9/2010 | Wallans et al. ..... 473/331 |
| 2001/0029208 | A1 | 10/2001 | Takeda |
| 2002/0025861 | A1 | 2/2002 | Ezawa |
| 2002/0037776 | A1 | 3/2002 | Krumme et al. |
| 2002/0094883 | A1 | 7/2002 | Chuang |
| 2002/0128088 | A1 | 9/2002 | Yializis et al. |
| 2002/0132683 | A1 | 9/2002 | Buchanan |
| 2002/0160857 | A1 | 10/2002 | Budzynski |
| 2003/0060306 | A1 | 3/2003 | Aldrich |
| 2003/0064824 | A1 | 4/2003 | Takeda |
| 2003/0119602 | A1 | 6/2003 | Kennedy, III et al. |
| 2003/0153399 | A1 | 8/2003 | Woodward et al. |
| 2003/0157995 | A1 | 8/2003 | Mahaffey |
| 2003/0220157 | A1 | 11/2003 | Dennis et al. |
| 2004/0009829 | A1 | 1/2004 | Kapilow |
| 2004/0014533 | A1 | 1/2004 | Joo et al. |
| 2004/0038746 | A1 | 2/2004 | Wahl et al. |
| 2004/0038749 | A1 | 2/2004 | De La Cruz |
| 2004/0067800 | A1 | 4/2004 | Kawano |
| 2004/0171434 | A1 | 9/2004 | Radcliffe et al. |
| 2004/0176182 | A1 | 9/2004 | Krumme et al. |
| 2005/0009629 | A1 | 1/2005 | Chao et al. |
| 2005/0009631 | A1 | 1/2005 | Krumme |
| 2005/0020378 | A1 | 1/2005 | Krumme et al. |
| 2005/0037859 | A1 | 2/2005 | Gilbert et al. |
| 2005/0054461 | A1 | 3/2005 | Pakarnseree et al. |
| 2005/0064954 | A1 | 3/2005 | Chen et al. |
| 2005/0075191 | A1 | 4/2005 | Bennett |
| 2005/0107183 | A1 | 5/2005 | Takeda et al. |
| 2005/0130764 | A1 | 6/2005 | Frame |
| 2005/0130765 | A1 | 6/2005 | Wieland et al. |
| 2005/0130766 | A1 | 6/2005 | Nakahara |
| 2005/0143190 | A1 | 6/2005 | Takeda |
| 2005/0187032 | A1 | 8/2005 | Dewanjee et al. |
| 2005/0215349 | A1 | 9/2005 | Huang et al. |
| 2005/0233829 | A1 | 10/2005 | Cameron |
| 2005/0246884 | A1 | 11/2005 | Chen |
| 2006/0009306 | A1 | 1/2006 | Bauer et al. |
| 2006/0030420 | A1 | 2/2006 | Roake |
| 2006/0052179 | A1 | 3/2006 | Hou |
| 2006/0135286 | A1 | 6/2006 | Imamoto et al. |
| 2006/0160634 | A1 | 7/2006 | Lee |

| | | | |
|---|---|---|---|
| 2006/0189408 | A1 | 8/2006 | Grace |
| 2006/0189409 | A1 | 8/2006 | Krumme |
| 2006/0189410 | A1 | 8/2006 | Soracco et al. |
| 2006/0194645 | A1 | 8/2006 | Sugimoto |
| 2006/0199661 | A1 | 9/2006 | Deng et al. |
| 2006/0217214 | A1 | 9/2006 | Cole |
| 2006/0252575 | A1 | 11/2006 | Chen |
| 2006/0281580 | A1 | 12/2006 | Kim et al. |
| 2006/0293119 | A1 | 12/2006 | Hou |
| 2007/0004535 | A1 | 1/2007 | Hsu |
| 2007/0021233 | A1 | 1/2007 | Blankenship et al. |
| 2007/0026964 | A1 | 2/2007 | Jones et al. |
| 2007/0026965 | A1 | 2/2007 | Huang |
| 2007/0049401 | A1 | 3/2007 | Tateno et al. |
| 2007/0049403 | A1 | 3/2007 | Chen |
| 2007/0066420 | A1 | 3/2007 | Imamoto et al. |
| 2007/0082753 | A1 | 4/2007 | Souza et al. |
| 2008/0039231 | A1 | 2/2008 | Lin et al. |

FOREIGN PATENT DOCUMENTS

| | | |
|---|---|---|
| JP | A-2004-236985 | 8/2004 |
| JP | A-2005-287667 | 10/2005 |

* cited by examiner

STRIKE FACE INSERT

RELATED U.S. APPLICATION DATA

Continuation of application Ser. No. 12/071,472, filed on Feb. 21, 2008.

BACKGROUND

Score lines or face grooves in conventional iron-type golf club heads allow the golfer to advantageously shape the shot trajectory during play. Score lines are typically produced by a machining process, such as a blind milling operation, where the depth and the profile of the milling cut must be precisely controlled. Blind milling requires frequent tooling changes to maintain the dimensional consistency of the milled features. The need for such tooling changes reduces manufacturing efficiency and increases production cost.

Conventional iron-type club heads commonly incorporate rudimentary ball-alignment characteristics, such as lines painted at the bottom of the club face, to assist the player in making accurate shots. However, such elemental sighting aids are often insufficient to provide accurate ball alignment and may also deteriorate and wear away over time.

SUMMARY

The present invention, in one or more aspects thereof, may comprise an iron-type golf club head with improved ball-alignment markings and an advantageous construction that promotes greater manufacturing efficiency and lower production cost.

In one example, a golf club head, according to one or more aspects of the present invention, may include a metallic striking wall comprising a striking surface and at least one through score-line opening. At least one complementary component may be disposed behind the striking surface and at least a part of the at least one complementary component may extend into only a part of the at least one through score-line opening.

In another example, a golf club head, according to one or more aspects of the present invention, may include a metallic striking wall comprising a striking surface and at least one through score-line opening. At least one complementary component may be disposed behind the striking surface in only a part of the at least one through score-line opening. An aft portion may be coupled to the complementary component behind the striking wall.

In yet another example, a golf club head, according to one or more aspects of the present invention, may include a striking wall comprising a striking surface. Additionally, the club head may include a top line wall comprising at least one through aperture therein. At least one complementary component may be disposed behind the striking surface and at least a part of the at least one complementary component may extend into at least a part of the at least one through aperture.

In yet another example, a golf club head, according to one or more aspects of the present invention, may include a metallic striking wall insert comprising a striking surface and at least one through score-line opening. At least one complementary component may be disposed behind the striking surface and at least a part of the at least one complementary component may extend into only a part of the at least one through score-line opening.

In yet another example, a golf club head, according to one or more aspects of the present invention, may include a metallic striking wall comprising a striking surface and at least one through score line opening. At least one complementary component may comprise an alignment feature that is at least partially perceivable through the at least one through score line opening.

These and other features and advantages of the golf club head according to the invention in its various aspects, as demonstrated by one or more of the examples described in detail below, will become apparent after consideration of the ensuing description, the accompanying drawings, and the appended claims. The accompanying drawings are for illustrative purposes only and are not intended to limit the scope of the present invention.

BRIEF DESCRIPTION OF THE DRAWINGS

Exemplary implementations of one or more aspects of the present invention will now be described with reference to the accompanying drawings, wherein.

DETAILED DESCRIPTION

Figure 1A:
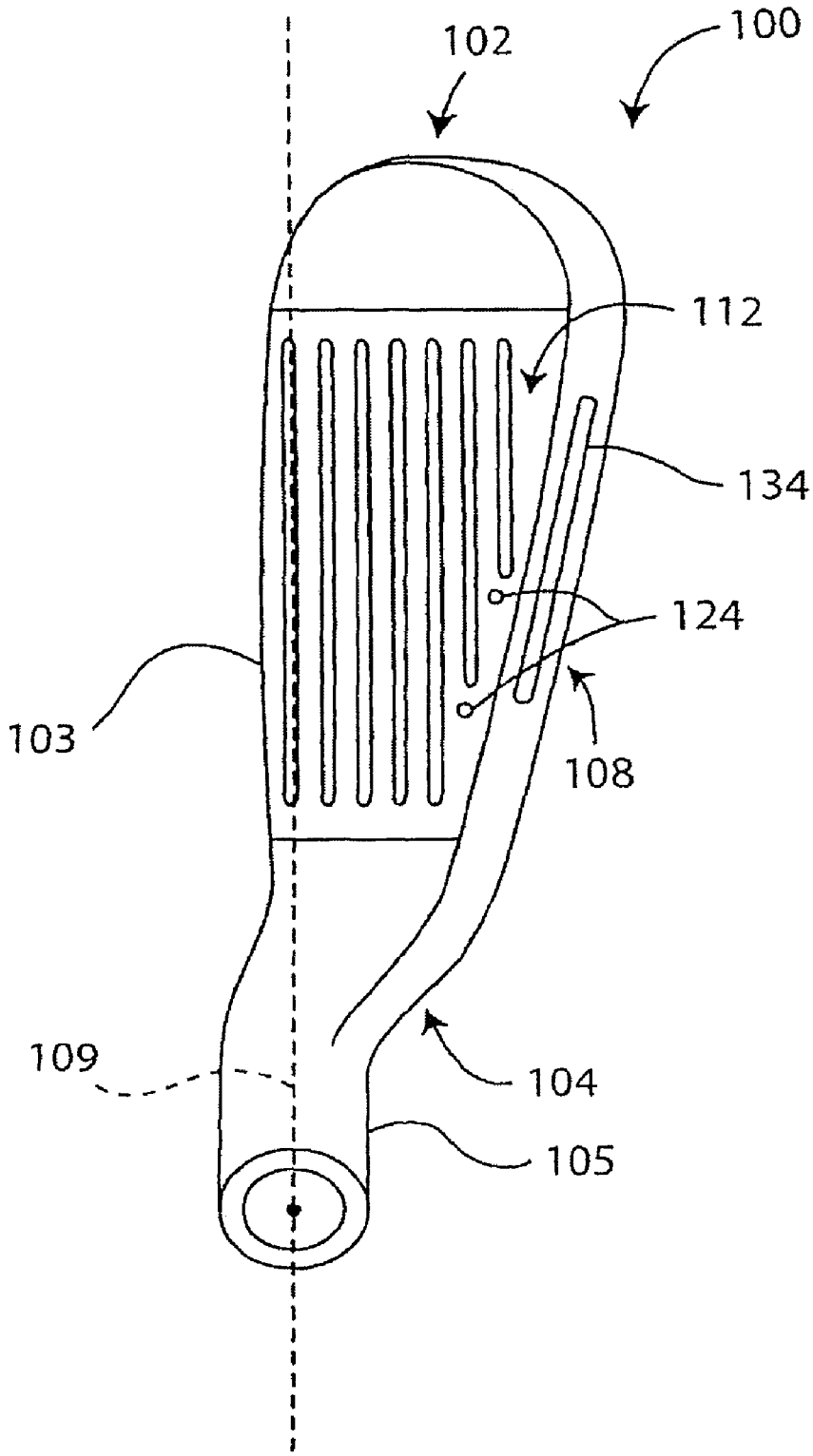
FIG. 1A is a top plan view of a club head according to one or more aspects of the present invention.
Figure 1B:
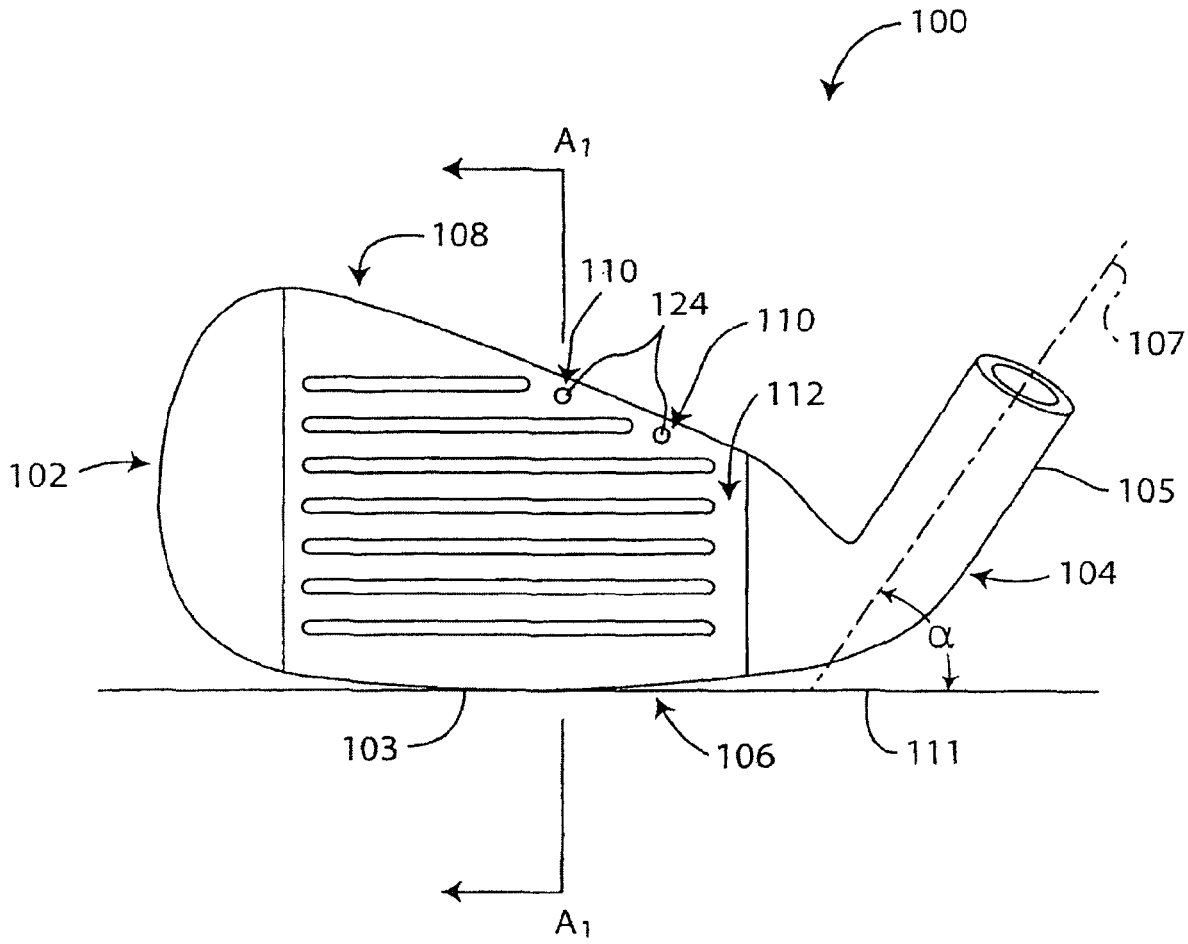
FIG. 1B is a front elevational view of the golf club head of FIG. 1A.

Referring to FIGS. 1A and 1B, a club head 100, according to one or more aspects of the present invention, may include a striking wall 112, a top-line wall 108, a leading edge 103, a toe 102, a heel 104, a sole wall 106, and a hosel 105 having a central axis or centerline 107. Unless otherwise indicated, all parameters described below are specified with the club head 100 in a "reference position." The reference position, as used herein, denotes a position of the club head 100 where the hosel centerline 107 is in an imaginary vertical plane 109 and is oriented at an actual lie angle $\alpha$ with respect to a ground plane 111. The plane 109 is oriented substantially parallel to the leading edge 103.

Figure 1C:
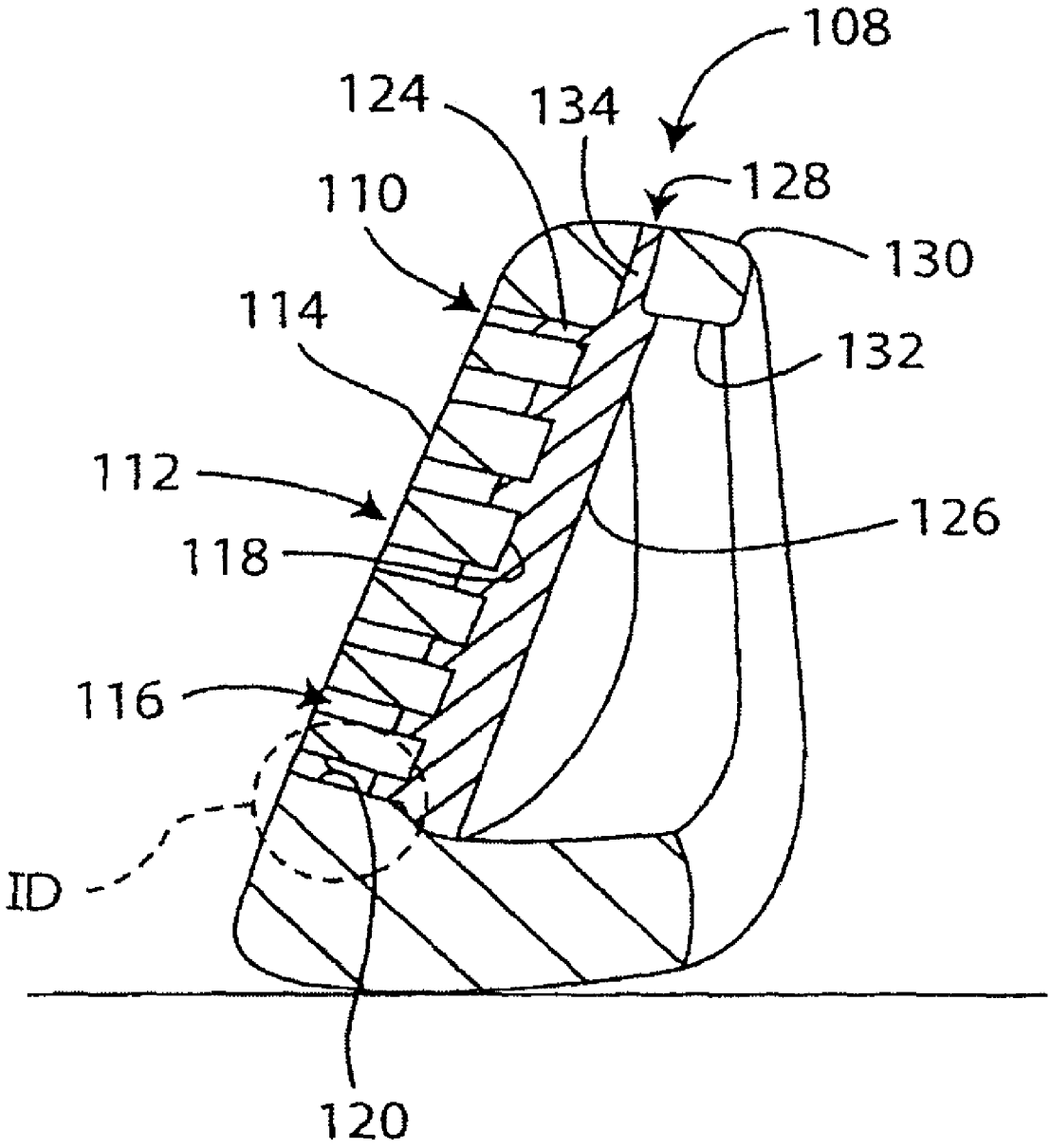
FIG. 1C is a cross-sectional view taken along the lines $A_1$-$A_1$ of FIG. 1B.

The club head 100 may be formed from a metallic material, e.g., 17-4 stainless steel, titanium, or the like, by a forging or a casting process. As shown in FIG. 1C, the striking wall 112 may have a thickness delimited by the shortest distance between a striking surface 114 and a rear surface 118. Preferably, the thickness of the striking wall is between about 0.6 mm and about 10 mm, more preferably between about 1 mm and about 5 mm, and most preferably between about 1 mm and about 3 mm. At least one score-line opening 116 may penetrate the striking wall 112. The at least one through score-line opening 116 may be formed via a variety of processes, e.g., hydro jet cutting, through-slot milling, or plasma cutting, to reduce production costs and increase production efficiency. Moreover, the at least one through score-line opening 116 may be provided with parallel or tapered side walls 120 and may be reinforced with stiffening members (not shown).

Referring again to FIG. 1C, at least a part of at least one complementary component, e.g., a complementary component 126, may be coupled to the striking wall 112, e.g., via an interference fit, mechanical interlocking, adhesive bonding, welding, or brazing. Preferably, the complementary component may comprise a light-weight metallic and/or non-metallic material, e.g., aluminum, polymer, or resin, thus promoting beneficial mass properties of the club head.

Figure 1D:
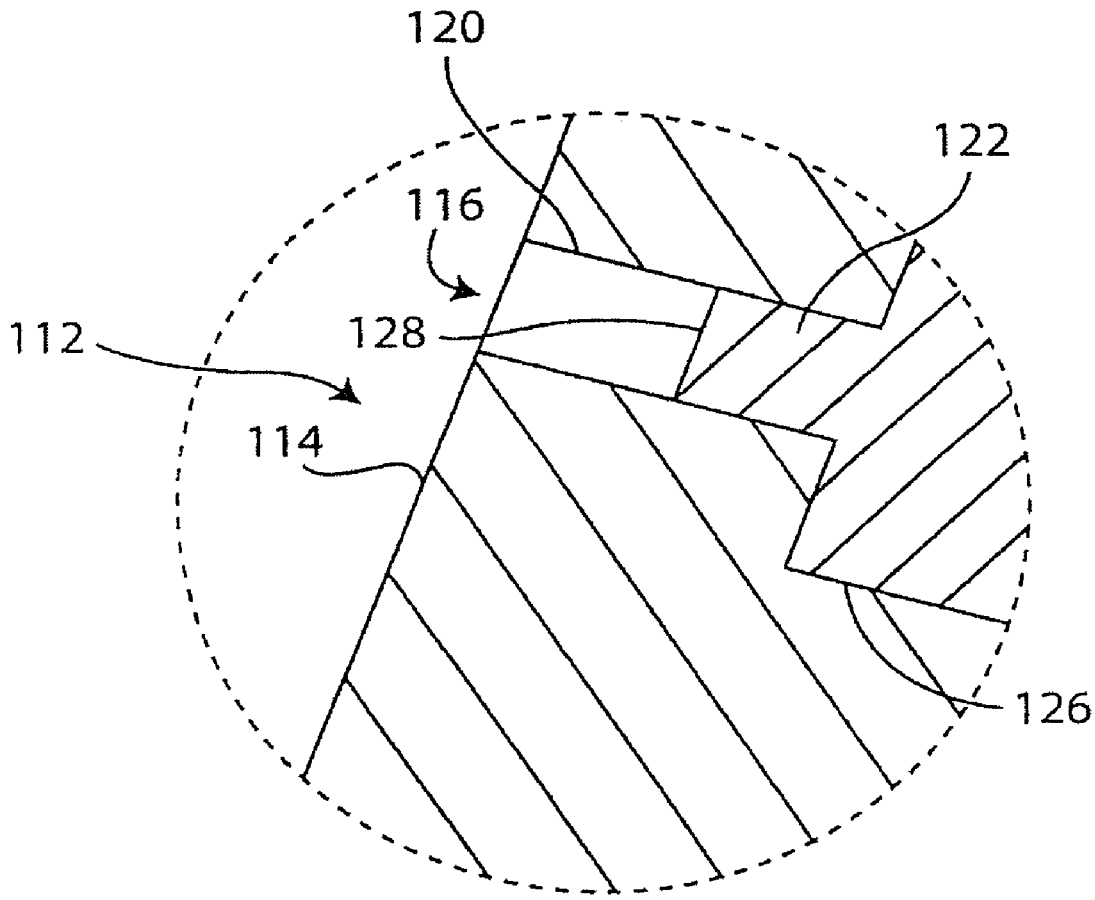
FIG. 1D is an enlarged cross-sectional view of a detail ID of FIG. 1C.

As illustrated in FIG. 1D, the complementary component 126 may include at least one projection, e.g., a projection 122, that may extend into only a part of the at least one through score-line opening 116. Accordingly, the score line corresponding to the opening 116 may have an effective depth characterized by the shortest distance between the striking surface 114 and an anterior surface 128 of the at least one projection 122. Preferably, the effective depth of the score line may be less than or equal to the maximum score-line depth allowed by the rules of golf. Thus, the thickness of the striking wall 112 is not restricted to the maximum allowable score-line depth.

Referring once again to FIGS. 1B and 1C, at least one through cavity 110 may penetrate the striking wall 112. The complementary component 126 may have at least one auxiliary projection 124 that may extend into at least a part of the at least one cavity 110. As shown in FIG. 1C, the auxiliary projection 124 may extend through the entire cavity 110 such that a portion of the auxiliary projection 124 is flush with the striking surface 114. Hence, the auxiliary projection 124 may function as an alignment feature on the striking surface 114. The alignment feature may help the golfer to properly address the golf club head and to align the club head with the ball at address, thus improving accuracy and distance.

Referring again to FIG. 1C, at least one aperture 128 may pass through the top-line wall 108 bounded by a top-line surface 130 and a peripheral surface 132. The complementary component 126 may have at least one supplemental projection 134 that may extend into at least a part of the at least one through aperture 128. The supplemental projection 134 may extend through the entire aperture 128 such that a portion of the supplemental projection 134 is flush with the top-line surface 130. Hence, the supplemental projection 134 may also function as an alignment feature.

Figure 2A:
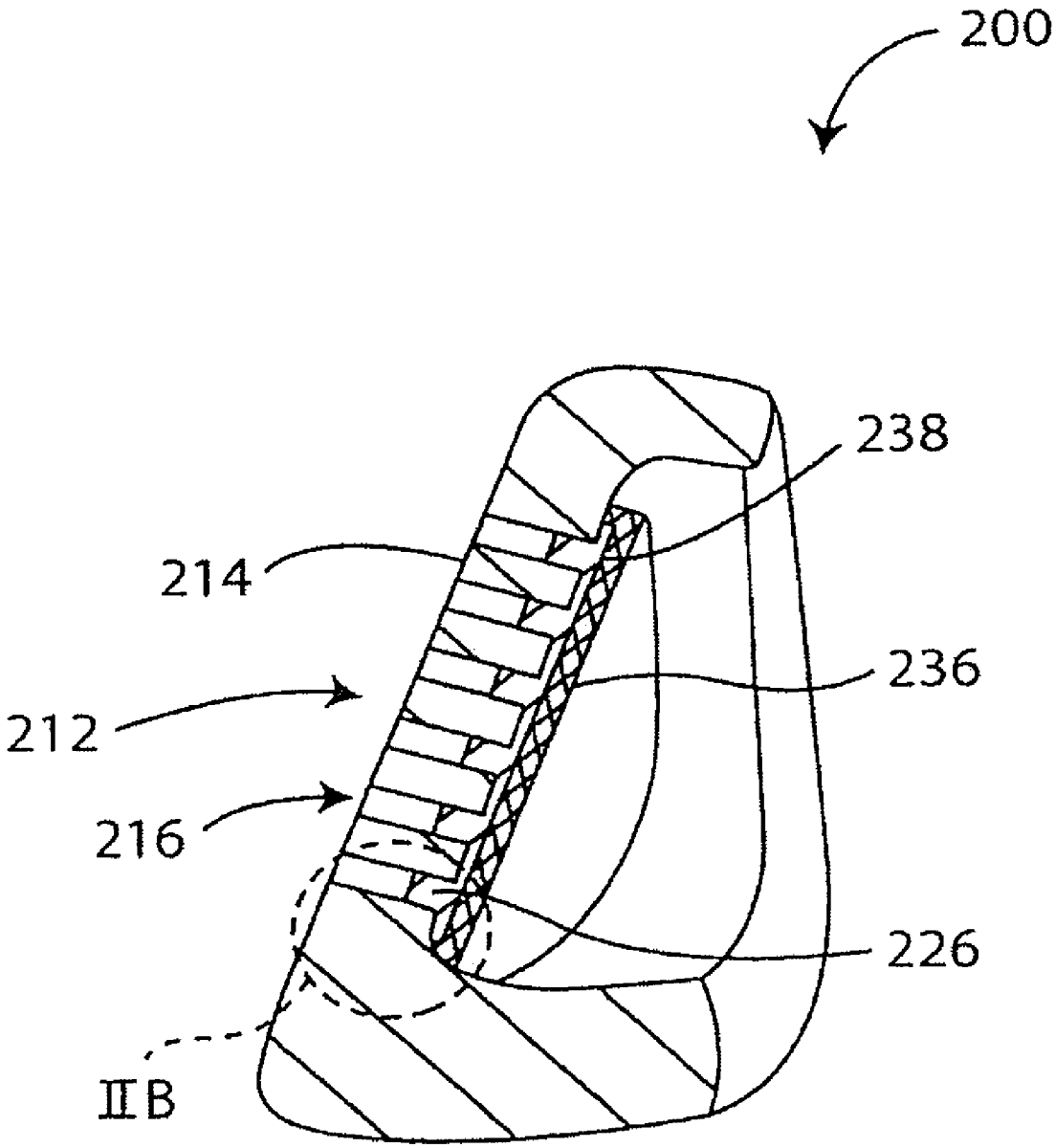
FIG. 2A is a cross-sectional view of a golf club head according to one or more aspects of the present invention.
Figure 2B:
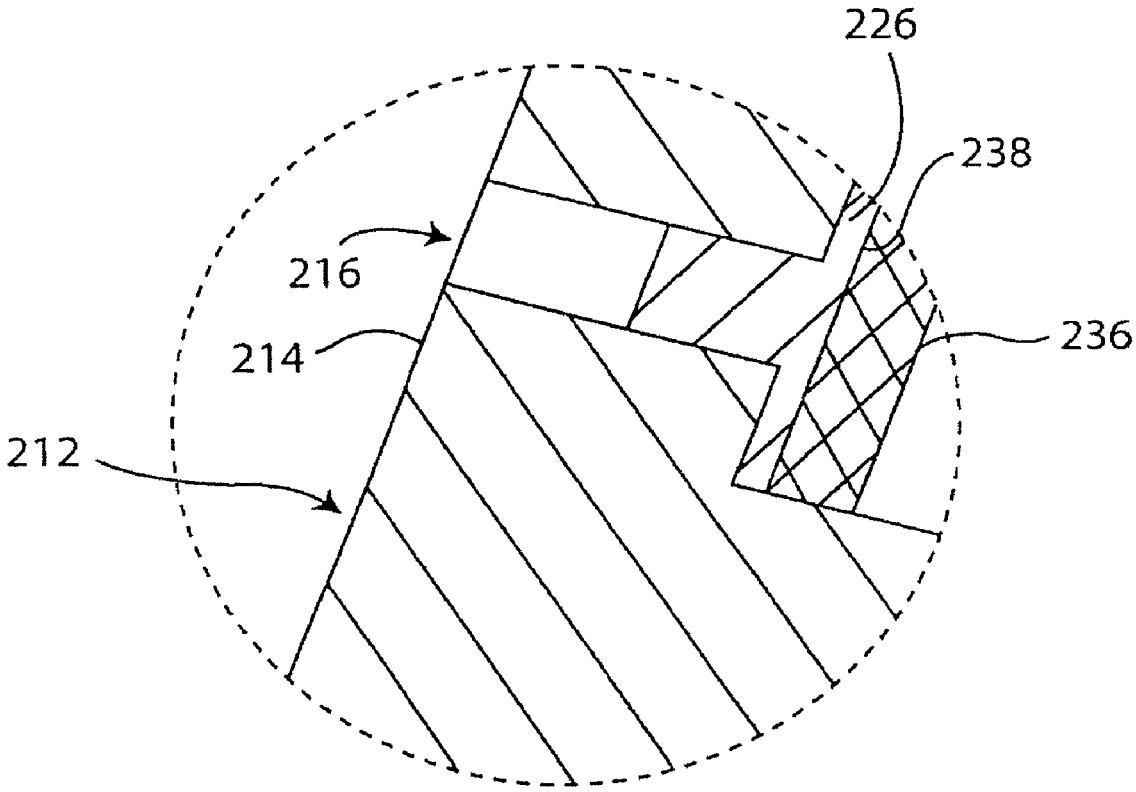
FIG. 2B is an enlarged cross-sectional view of a detail IIB of FIG. 2A.

With reference to FIGS. 2A and 2B, a golf club head 200, according to one or more aspects of the present invention, may include a striking wall 212, having a striking surface 214 and at least one through score-line opening 216. At least a part of at least one complementary component, e.g., a complementary component 226, may be disposed behind the striking surface 214 in only a part of the at least one through score-line opening 216. As illustrated in FIGS. 2A and 2B, an aft portion 236 may be coupled to the complementary component 226 at a posterior surface 238, e.g., by an adhesive material, to provide improved damping of the club head. For example, the aft portion 236 may comprise a constrained-layer damper that dissipates undesirable vibration during ball impact and improves the overall feel of the club head. Preferably, the aft portion 236 may be formed from a metallic and/or a non-metallic material, e.g., aluminum, polymer, or resin.

Figure 3A:
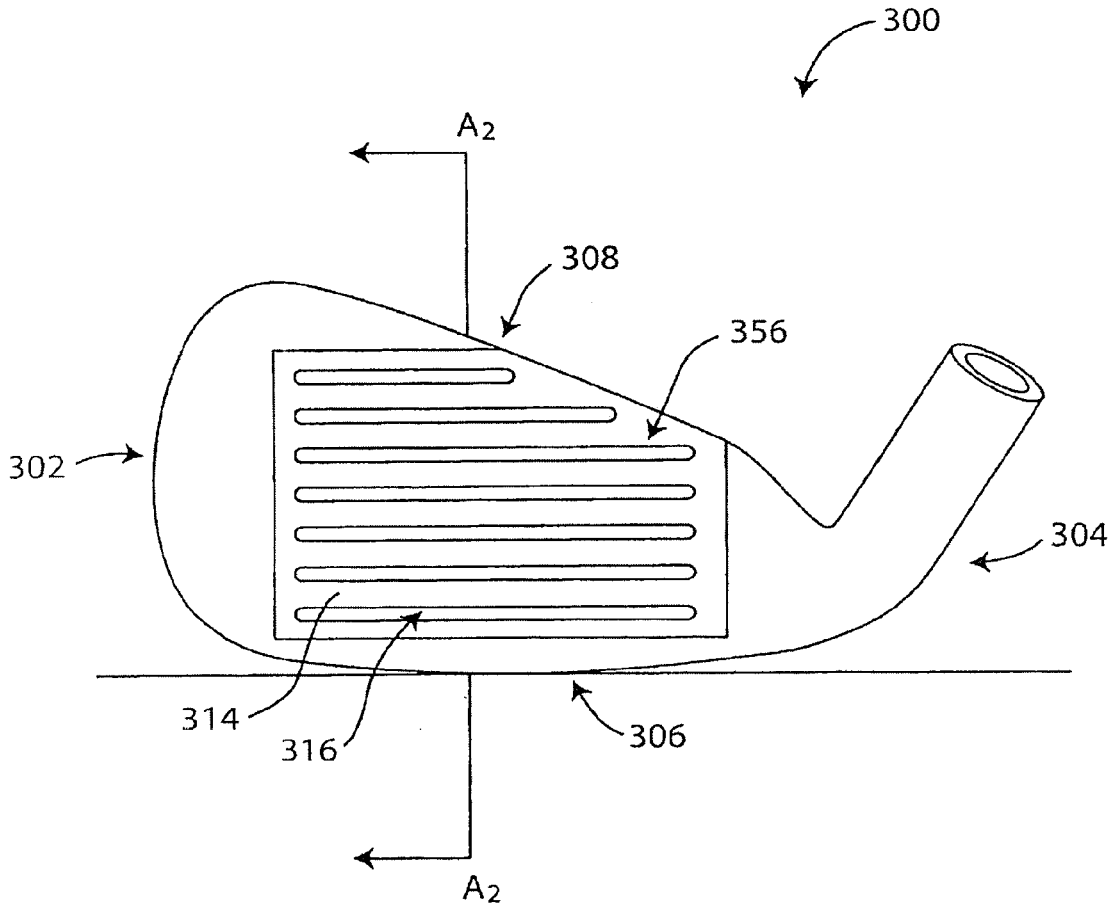
FIG. 3A is a front elevational view of a golf club head according to one or more aspects of the present invention.
Figure 3B:
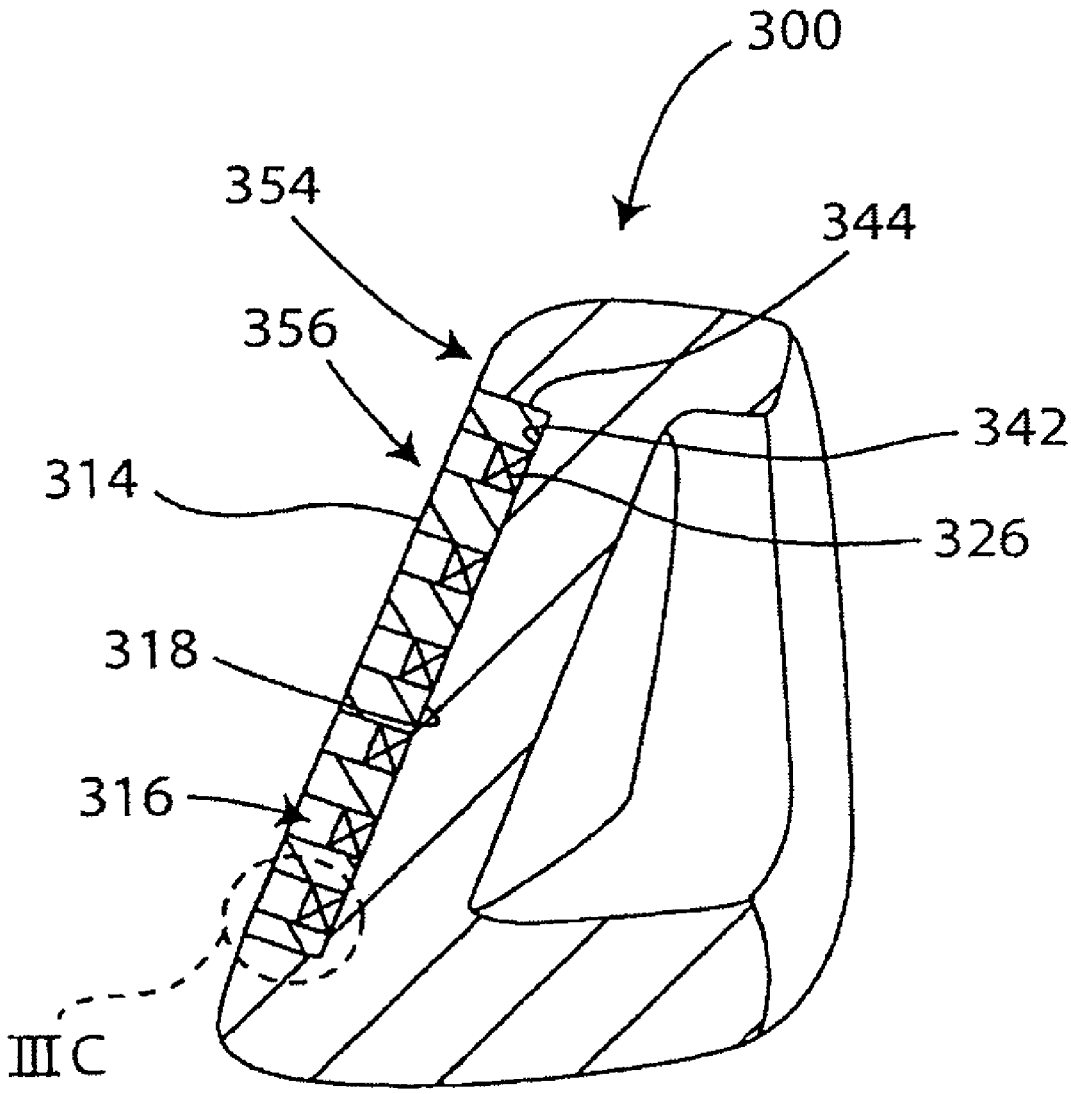
FIG. 3B is a cross-sectional view taken along the lines $A_2$-$A_2$ of FIG. 3A.

In another example, shown in FIGS. 3A and 3B, a golf club head 300, according to one or more aspects of the present invention, may include a striking wall insert 356 and a chassis 354. The chassis may have a recess 344 delimited by a toe 302, a heel 304, a sole wall 306, a top-line wall 308, and a base surface 342. The striking-wall insert 356 may be disposed in the recess 344 and may be coupled to the chassis 354, e.g., by an adhesive material, an interference fit, welding, or other attachment methods. The striking-wall insert 356 may include a striking surface 314 and at least one through score-line opening 316.

Figure 3C:
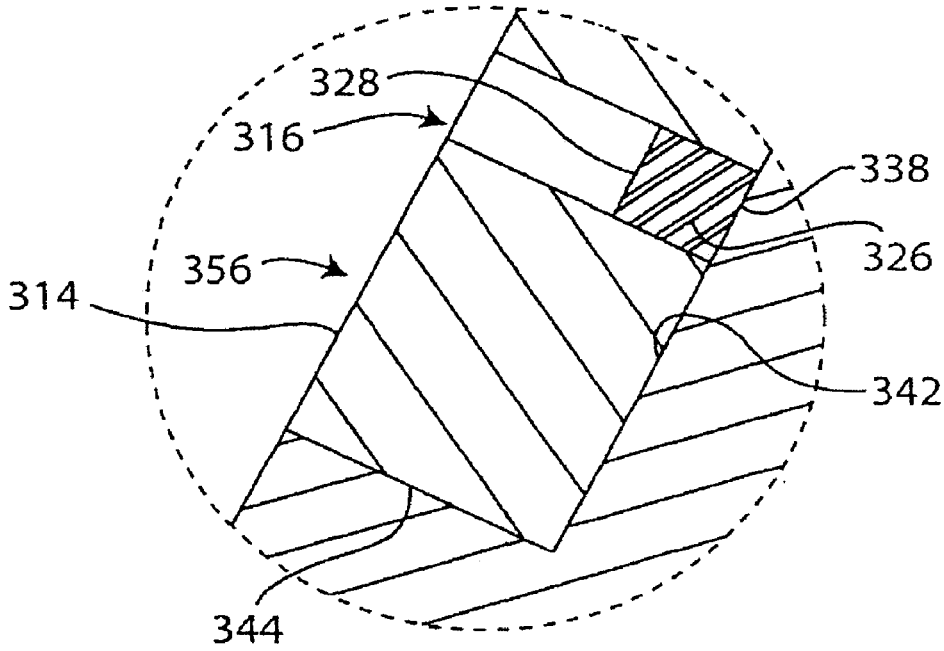
FIG. 3C is an enlarged cross-sectional view of a detail IIIC of FIG. 3B.

Referring to FIGS. 3B and 3C, at least one complementary component, e.g., a complementary component 326, may be disposed in only a part of the through score-line opening 316. The complementary component 326 may have an anterior surface 328 that may function as the bottom surface of a score line corresponding to the opening 316. Thus, the score line may have an effective depth characterized by the shortest distance between the striking surface 314 and the anterior surface 328. The complementary component 326 may be fixed in the score-line opening 316, e.g., by an interference fit, mechanical interlocking, welding, or adhesive bonding, before or after attaching the striking-wall insert 356 to the chassis 354.

Figure 3D:
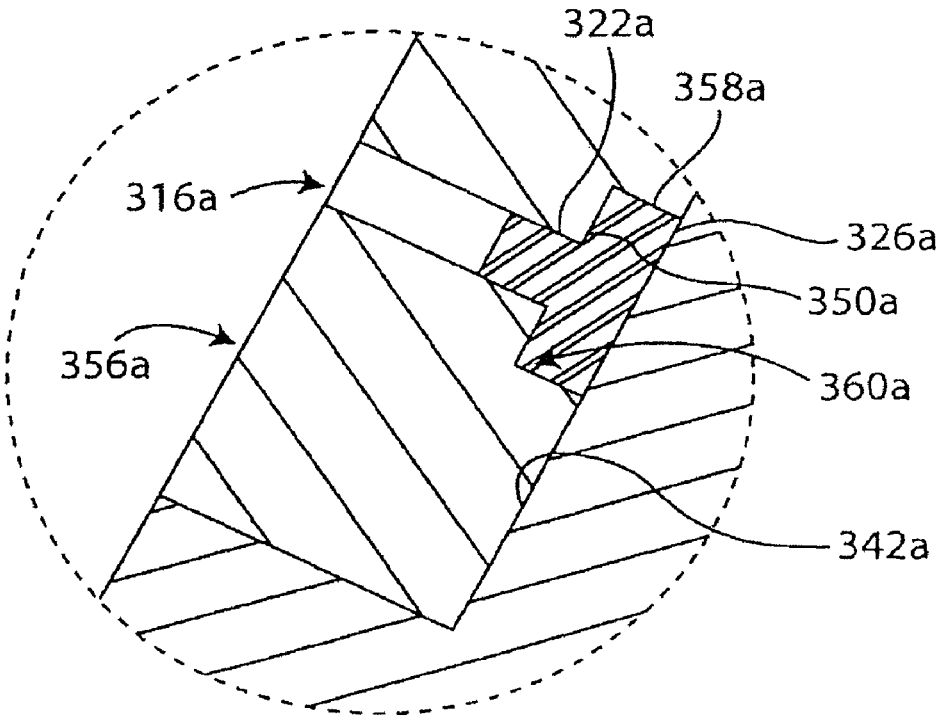
FIG. 3D is an enlarged cross-sectional view of a detail of a golf club head according to one or more aspects of the present invention.

In an alternative configuration of the club head according to one or more aspects of the present invention, shown in FIG. 3D, a striking face insert 356*a* may include at least one through score-line opening 316*a*, having a stepped portion 360*a* containing a ledge 350*a*. At least one complementary component, e.g., a complementary component 326*a*, may be disposed in only a part of the at least one through score-line opening 316*a*. The complementary component 326*a* may include an elongated base 358*a* and a projection 322*a*. The elongated base 358*a* may be interposed between the ledge 350*a* and a base surface 342*a* to secure the complementary component 326*a* in the score-line opening 316*a*.

Figure 3E:
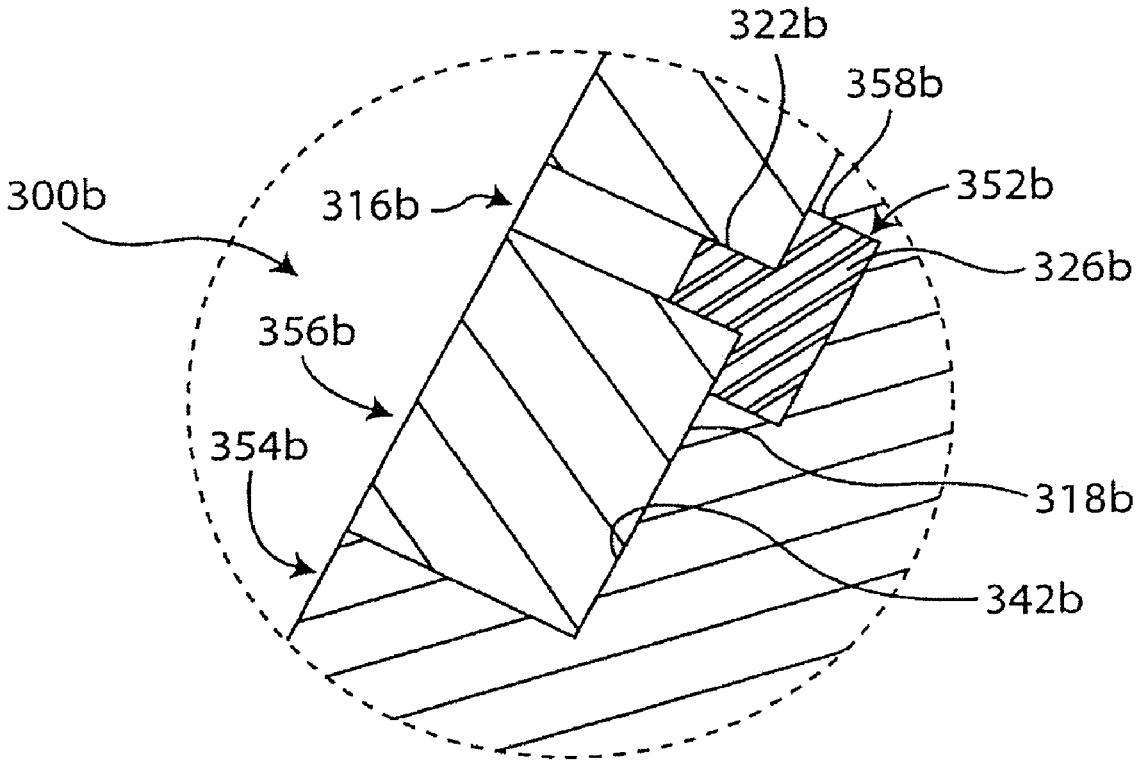
FIG. 3E is an enlarged cross-sectional view of a detail of a golf club head according to one or more aspects of the present invention.

In another example, shown in FIG. 3E, a golf club head 300*b*, according to one or more aspects of the present invention, may have a striking wall insert 356*b*, coupled to a chassis 354*b*. The striking wall insert 356*b* may include at least one through score-line opening 316*b*, having at least a part of at least one complementary component, e.g., a complementary component 326*b*, disposed therein. The chassis 354*b* may include a base surface 342*b* having a blind cavity 352*b*. The complementary component 326*b* may comprise a projection 322*b* and a base 358*b*, at least partially disposed in the blind cavity 352*b*. The projection 322*b* may extend into only a part of the score-line opening 316*b* and may form the bottom surface of the score line corresponding to the opening 316*b*. The base 358*b* may be interposed between a rear surface 318*b* of the striking wall insert 356*b* and the bottom surface of the blind cavity 352*b* to secure the complementary component 326*b* in the score-line opening 316*b*.

Figure 4A:
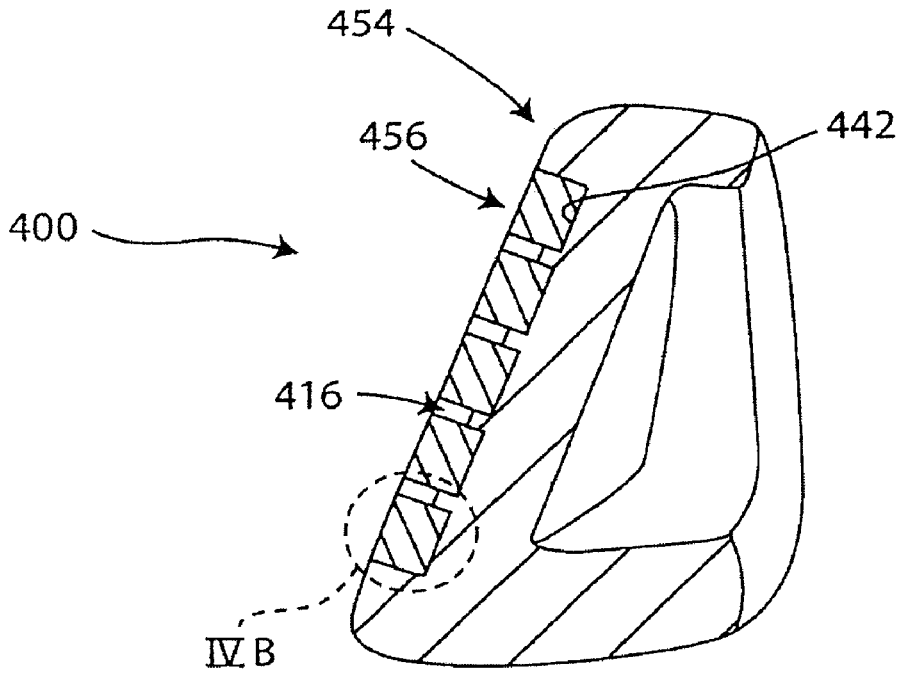
FIG. 4A is a cross-sectional view of a golf club head according to one or more aspects of the present invention.
Figure 4B:
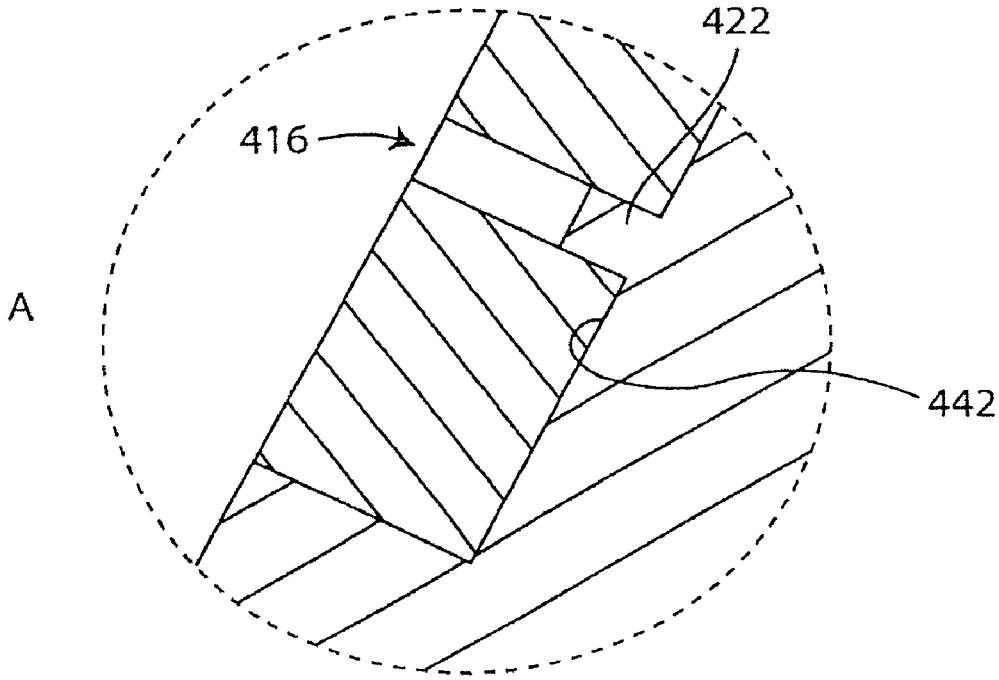
FIG. 4B is an enlarged cross-sectional view of a detail IVB of FIG. 4A.

As discussed below, the chassis may also function as a complementary component. Referring to FIGS. 4A and 4B, a golf club head 400, according to one or more aspects of the present invention, may include a striking wall insert 456, coupled to a chassis 454. The chassis 454 may comprise a base surface 442, having at least one protrusion, e.g., protrusion 422, integrally formed thereon. The protrusion 422 may extend into only a part of at least one through score-line opening 416.

Figure 5:
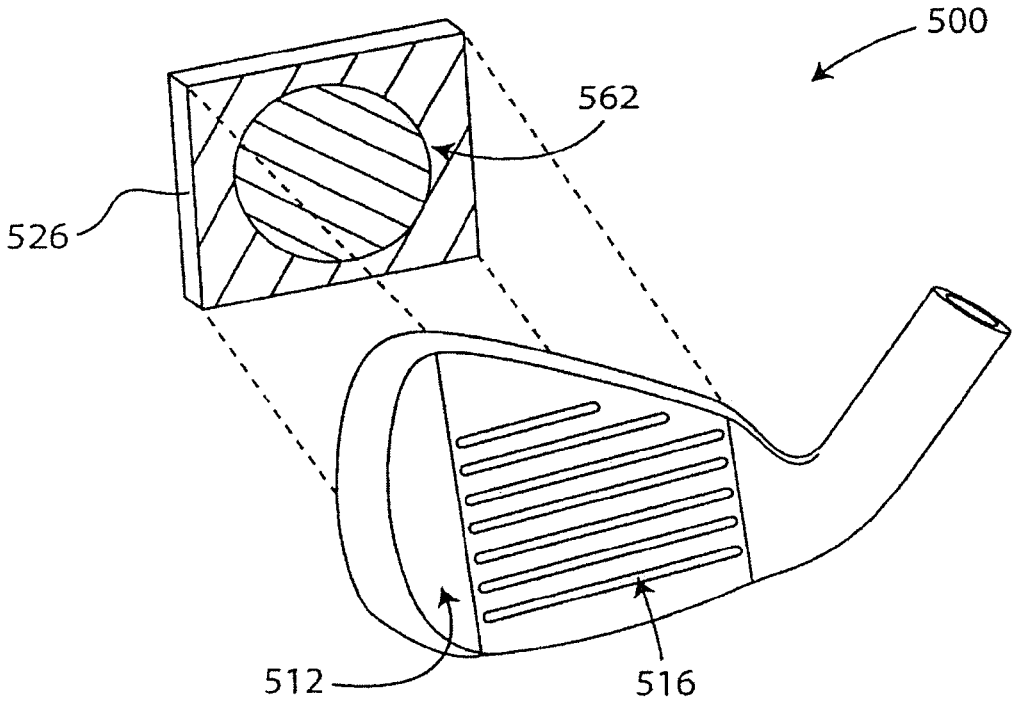
FIG. 5 is an exploded perspective view of a golf club head according to one or more aspects of the present invention.

With reference to FIG. 5, a golf club head 500, according to one or more aspects of the present invention, may include a striking wall 512, coupled to a complementary component 526. The complementary component 526 may comprise an alignment feature, e.g., an alignment feature 562, characterized by a plurality of contrasting surface treatments, e.g., contrasting colors. Preferably, the alignment feature 562 may be perceived through at least one through score-line opening 516 of the striking wall 512. As described above, an alignment feature may help the golfer to properly address the golf club head and to align the club head with the ball at address, thus improving accuracy and distance. Although the alignment feature 562 may have the general appearance of a circle, other alignment indicia, e.g., triangular alignment markings, rectangular alignment markings, trapezoidal alignment markings, irregular or any other suitably shaped alignment markings, are contemplated to be within the scope of the present invention in one or more aspects thereof.

Figure 6:
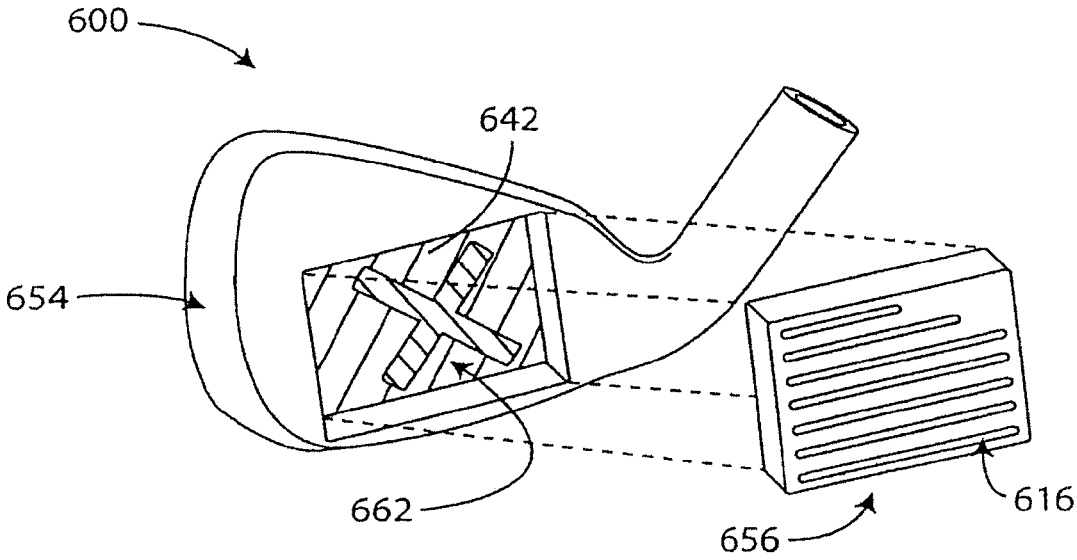
FIG. 6 is an exploded perspective view of a golf club head according to one or more aspects of the present invention.

In another example, shown in FIG. 6, a golf club head 600, according to one or more aspects of the present invention, may include a striking-wall insert 656 coupled to a chassis 654. The chassis 654 may comprise a base surface 642 having, an alignment feature, e.g., alignment feature 662, disposed thereon. The alignment feature 662 may be perceived through at least one through score line opening 616 of the striking-wall insert 656.

Although the examples provided above are described with respect to an iron-type club head, it may be appreciated that similar features may be provided on putter-type club heads, wood-type club heads, and hybrids.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

The invention claimed is:

1. A golf club head comprising:

a metallic striking wall comprising a striking surface and at least one elongate through score-line opening extending across a majority of the metallic striking wall, the at least one elongate through score-line opening having a stepped portion including a ledge;

a chassis comprising a recess including a base surface, wherein the metallic striking wall is at least partially located in the recess; and at least one complementary component rearward of the striking surface and including a base, at least a part of the at least one complementary component extending into only a part of the at least one through score-line opening, wherein the base of the at least one complementary component is interposed between the ledge of the at least one through score-line opening and the base surface of the recess.

2. The golf club head of claim 1, wherein the metallic striking wall further comprises a thickness between about 0.6 mm and about 10 mm.

3. The golf club head of claim 2, wherein the thickness of the metallic striking wall is between about 1 mm and about 5 mm.

4. The golf club head of claim 3, wherein the thickness of the metallic striking wall is between about 1 mm and about 3 mm.

5. The golf club head of claim 1, wherein the at least one complementary component comprises a non-metallic material.

6. The golf club head of claim 1 further comprising an aft portion coupled to the at least one complementary component.

7. The golf club head of claim 6, wherein the aft portion comprises a non-metallic material.

8. The golf club head of claim 6, wherein the aft portion comprises a constrained layer damper.

9. The golf club head of claim 1, wherein the at least one through score-line opening is formed by hydro-jet cutting.

10. The golf club head of claim 1, wherein the at least one through score-line opening is formed by through-slot milling.

11. A golf club head comprising:

a metallic striking wall comprising a striking surface and at least one elongate through score-line opening extending across a majority of the metallic striking wall, the at least one elongate through score-line opening including side walls formed in the metallic striking wall; and a chassis comprising a recess having a base surface and at least one protrusion extending from the base surface, at least a part of the at least one protrusion extending into only a part of the at least one through score-line opening and having an anterior surface recessed in its entirety from the striking surface, wherein at least a portion of the side walls of the at least one elongate through score-line opening and at least a portion of the anterior surface of the at least one protrusion are visually exposed and delimit at least a portion of at least one face groove.

12. The golf club head of claim 11, wherein the metallic striking wall further comprises a thickness between about 0.6 mm and about 10 mm.

13. The golf club head of claim 12, wherein the thickness of the metallic striking wall is between about 1 mm and about 5 mm.

14. The golf club head of claim 13, wherein the thickness of the metallic striking wall is between about 1 mm and about 3 mm.

15. The golf club head of claim 11, wherein the at least one through score-line opening is formed by hydro-jet cutting.

16. The golf club head of claim 11, wherein the at least one through score-line opening is formed by through-slot milling.

17. The golf club head of claim 16, further comprising a non-metallic material.

18. The golf club head of claim 17, further comprising a top-line wall including at least one through aperture, the non-metallic material extending into at least a part of the at least one through aperture.

19. The golf club head of claim 17, wherein the metallic striking wall further comprises at least one through cavity, the non-metallic material extending into at least a part of the at least one through cavity.

20. The golf club head of claim 11, further comprising a constrained layer damper.

* * * * *